US005448215A

United States Patent [19]

Sokai

[11] Patent Number: 5,448,215

[45] Date of Patent: Sep. 5, 1995

[54] STATIONARY INDUCTION APPARATUS

[75] Inventor: Katsuji Sokai, Hyogo, Japan

[73] Assignee: Mitsubishi Denki Kabushiki Kaisha, Tokyo, Japan

[21] Appl. No.: 213,063

[22] Filed: Mar. 15, 1994

[30] Foreign Application Priority Data

Mar. 19, 1993 [JP] Japan ..... 5-060115

[51] Int. Cl.[6] ..... H01F 27/08

[52] U.S. Cl. ..... 336/57; 336/60

[58] Field of Search ..... 336/60, 55, 57, 58

[56] References Cited

U.S. PATENT DOCUMENTS

| | | | |
|---|---|---|---|
| 1,543,546 | 6/1925 | Burnham | 336/60 |
| 3,548,354 | 12/1970 | Schwab | 336/60 |
| 3,902,146 | 8/1975 | Muralidhanan | 336/60 |
| 4,207,550 | 6/1980 | Daikoku et al. | 336/60 |
| 4,363,012 | 12/1982 | Daikoka et al. | 336/60 |
| 4,588,972 | 5/1986 | Harumoto et al. . | |
| 5,138,294 | 8/1992 | Yoshikawa . | |

FOREIGN PATENT DOCUMENTS

| | | | |
|---|---|---|---|
| 493437 | 11/1918 | France | 336/60 |
| 55-22870 | 2/1980 | Japan | 336/60 |
| 55-46526 | 4/1980 | Japan | 336/60 |
| 61-295613 | 12/1986 | Japan | 336/60 |
| 2-49408 | 2/1990 | Japan | 336/60 |
| 3-135005 | 6/1991 | Japan | 336/60 |
| 167916 | 8/1921 | United Kingdom . | |
| 671287 | 4/1952 | United Kingdom . | |

OTHER PUBLICATIONS

Patent Abstracts of Japan, vol. 5, No. 159, Oct. 14, 1981.
Patent Abstracts of Japan, vol. 5, No. 141, Sep. 5, 1981.

*Primary Examiner*—Thomas J. Kozma
*Attorney, Agent, or Firm*—Sughrue, Mion, Zinn, Macpeak & Seas

[57] ABSTRACT

A stationary reduction apparatus is arranged so that coil groups comprising plate type (or disc type) coils, which are stacked up in multiple layers with spacers inserted therebetween to traverse through a core whereby a refrigerant may pass through inter-layer clearances, are provided and divided into a plurality of coil sub-groups and every other coil sub-group of the divided coil sub-groups is surrounded by a refrigerant guide which is provided with an opening on its internal periphery and refrigerant flow ports on its external periphery, and the refrigerant is introduced into the refrigerant guide to flow in a horizontal direction through respective inter-layer clearances of the stacked-up coil groups, thereby the coil groups are effectively cooled without accelerating the velocity of refrigerant flow.

3 Claims, 9 Drawing Sheets

STATIONARY INDUCTION APPARATUS

BACKGROUND OF THE INVENTION

1. Field of the Invention

The present invention relates to a stationary induction apparatus such as a transformer and a reactor.

2. Description of the Prior Art

FIG. 9 is a cross sectional view showing an example of a conventional core type oil-supplied transformer disclosed, for example, in the Patent Application Disclosure No. 78109-1981. In FIG. 9, numeral 1 denotes a tank of a main unit, 2 is a core, 3 is an internal coil group inserted into a leg part of the core 2, 4 is an external coil group arranged on an external periphery of the internal coil group 3, 5 is a core clamp fixture which clamps a yoke part of the core 2 and simultaneously supports the internal coil group 3 and the external coil group 4. The core 2 is formed by stacking up silicon steel sheets in multiple layers with a clearance 2*a* provided therebetween adjacent layers of silicon steel sheets and constructed so as to permit a refrigerant to pass through these clearances 2*a*. The internal coil group 3 is formed by stacking up disc type coils 3*a*, wherein a spacer 3*a*1 is inserted respectively between every two adjacent coils so that the refrigerant passes through the disc type coils and spacers. The external coil group 4 is formed by stacking up disc type coils 4*a*, wherein a spacer 4*a*1 is inserted respectively between every two adjacent coils. 6 is an insulation plate inserted between the internal coil group 3 and the external coil group 4 and the core clamp fixture 5, and a plurality of refrigerant flow ports 6*a* through which the refrigerant is permitted to flow are provided at respective intermediate positions of the insulation plate 6 and the core clamp fixture 5, with which the internal coil group 3 and the external coil group 4 come in contact, at equal pitches of distance in the circumferential direction. 7 is an insulation barrier provided between the internal coil group 3 and the external coil group 4 and 8 is an insulation barrier between the external coil group 4 and the tank 1. 9 is a cooler which discharges a loss heat such as a Joule heat which is produced in the main unit due to the circulation of the refrigerant, 10 is a pump which circulates the refrigerant, 11 is a piping which connects the upper part of the tank 1 and the upper part of the cooler 9, and 12 is a piping which connects the lower part of the cooler 9 and the lower part of the tank 1. 13 is a side pipe for limiting the flow of refrigerant in the internal coil group 3 and the external coil group 4 included in the main unit to a fixed volume and 14 is a control valve for controlling the volume of refrigerant which flows in the side pipe 13. 15 is a refrigerant chamber which discharges the refrigerant cooled in the cooler 9.

The tank 1 of the main unit is filled with an insulation oil which serves as a refrigerant.

FIG. 10 shows an embodiment as a shell type oil-supplied transformer is viewed from a position where the coil is seen in the horizontal direction. In FIG. 10, 21 is a main unit tank, 22 is a core, 23 is a low voltage coil group formed by stacking up a plurality of low voltage coils 23*a* which are arranged to traverse the core 22, 24 is a high voltage coil group formed by stacking up a plurality of high voltage coils 24*a* which are arranged to traverse the core 22. The low voltage coil group 23 and the high voltage coil group 24 are respectively formed by stacking up low voltage coils 23*a* and high voltage coils 24*a*, which are respectively wound in the shape of flat plate, in multiple layers, and the high voltage coil group 24 is arranged at the center and the low voltage coil group 23 is divided into two groups, which are respectively arranged both above and below the high voltage coil group 24. Spacers, not shown, are inserted between plate type low voltage coils 23*a* and high voltage coils 24*a* which are arranged in multiple layers to maintain spaces through which the refrigerant flows. 25 is refrigerant flow guides which are arranged so as to surround the coil groups expect for the opposing sides of the low voltage coil group 23 and the high voltage coil group 24, so that one of the sides forms an refrigerant inlet port and another one forms a refrigerant outlet port. 26 is an insulation plate which secures a refrigerant passage inside the low voltage coil group 23 and the high voltage coil group 24 by arranging the refrigerant passage along the upper and lower surfaces on which the two divided low voltage coil group 23 and the high voltage coil group 24 are stacked up in multiple layers and also ensures a dielectric strength between the low voltage and high voltage coil groups 23 and 24 and the core 22. 29 is a cooler, 30 is a pump, and 31 and 32 are a piping which connects the cooler 29 and the tank 21. 35*a* and 35*b* denote refrigerant chamber through which the refrigerant flows into the tank and through which the refrigerant flows out from the tank, respectively.

The operation of the stationary induction apparatus is described below. In a core type oil-supplied transformer shown in FIG. 9, a refrigerant contained in a tank 1 is pressurized by a pump 10 to flow into a lower part of the tank 1, then flows to the sides of an internal coil group 3 and an external coil group 4 through a refrigerant flow port 6*a* provided in a core clamp fixture 5 and an insulation plate 6 and is divided into a flow passage which flows up along the sides of the internal coil group 3 and the external coil group 4 to reach the upper part of the tank and a flow passage which flows up through an intermediate clearance 2*a* of the core 2 and a space between the core 2 and the internal coil group 3 to reach the upper part of the tank, then flows up into the upper part of the tank 1 while cooling the internal coil group 3, the external coil group 4 and the core 2. Since there is a problem that, if the flow rate of the refrigerant which passes through the internal coil group 3 and the external coil group 4 is excessively accelerated, a static charge is produced due to friction between the refrigerant and the insulation material applied to the surfaces of the coils and accumulated on the surface of this insulation material and, if the accumulated static charge exceeds the limit, static discharging may occur to trigger a dielectric breakdown, the discharge from the pump 10 is shunted to a side piping 13 so that the flow rate of refrigerant at the sides of the internal coil group 3 and the external coil group 4 does not exceed the specified value and the refrigerant flow is by-passed by a control valve 14 to the upper part of the tank 1 to control the flow rate, thus controlling the flow rate of refrigerant along the sides of the internal coil group 3 and the external coil group 4. The refrigerant in the upper part of the tank 1 is sucked by the cooler 9 through the piping 11 and goes down to reach the pump 10 while being cooled, thus this refrigerant is circulated through this channel.

In a shell type oil-supplied transformer shown in FIG. 10, a low voltage coil group 23 and a high voltage coil group 24 are arranged in multiple layers and a refrigerant in a tank 21 is pressurized by a pump 30 to flow into a refrigerant chamber 35*a* located at the left side in the tank 21 as shown, then shunted into a channel from a refrigerant flow inlet 25*a* provided in the coil groups 23 and 24 to reach a refrigerant flow outlet 25*b* through tiered clearances of the low voltage coil group 23 and the high voltage coil group 24 and flow to a refrigerant chamber 35*b* at the right side in the tank 21 as shown while cooling the low voltage coil group 23 and the high voltage coil group 24 and a channel where the refrigerant flows up along the multiple-layered surfaces of the core 22, then flows into the refrigerant chamber 35*b* at the right side in the tank 21 as shown. The refrigerant in the refrigerant chamber 35*b* at the right side in the tank 21 as shown is sucked and cooled by the cooler 29 and circulated through a channel which reaches the pump 30. Though not shown, a refrigerant passage is formed between the core 22 and the tank 21 and between the core 22 and the low voltage coil group 23 and the high voltage coil group 24 so as to optimize cooling of the core 22.

Subjects to be Solved by the Invention

The conventional stationary induction apparatus with the construction as described above includes the problems as described below.

In the core type oil-supplied transformer shown in FIG. 9, there is a problem that the refrigerant which has passed the part including the internal coil group 3, external coil group 4 and core 2 is mixed with the refrigerant which has been by-passed through the side piping 13 without passing through the main unit to lower its temperature and flows into the cooler 9 while its temperature is kept low, and it is necessary to increase the number of coolers to ensure the specified radiation value in the cooler 9 and, on the other hand, there is a problem that a static charge occurs, as described above, if the flow rate of refrigerant which flows through the part including the internal coil group 3 and the external coil group 4 is accelerated and therefore the flow rate cannot be increased over the specified value. Accordingly, there is further a problem that it is necessary to take a measure for reducing the density of the current to reduce heat loss which occurs in the internal coil group 3 and the external coil group 4 and therefore the dimensions of the apparatus will be larger.

In a shell type oil-supplied transformer shown in FIG. 10, the refrigerant flows into the low voltage coil group 23 and the high voltage coil group 24 through the refrigerant flow inlet port 25*a* provided at one ends of the low voltage coil group 23 and the high voltage coil group 24, flows through the flow passage shown with W in FIG. 10 and flows out from the refrigerant flow outlet port 25*b* provided at the other ends of the above coil groups. Accordingly, the area of the flow passage is small and the length of the flow passage is long and therefore the temperature of refrigerant between the refrigerant flow inlet port 25*a* and the refrigerant flow outlet port 25*b* rises and it is necessary to increase the flow rate of the refrigerant by accelerating the flow speed. However, if the flow speed is accelerated, the above described problem of static charge is anticipated and therefore there is a problem that a measure is required to control the quantity of heat to be produced to a low level by designing the density of the current which flows through the coils of the low voltage coil group 23 and the high voltage coil group 24 and the apparatus requires larger dimensions.

In the above description, it is assumed that an insulation oil is used as the refrigerant; however, the transformer can be a gas-supplied type transformer by using an insulation gas such as SF6 gas as the refrigerant.

In this case, the thermal capacity per volume of SF6 gas used as the refrigerant is smaller than that of the insulation oil and therefore the flow rate of the refrigerant need be larger. However, it is limited to increase the flow rate of gas in the coil groups in the same construction as the oil-supplied type transformer and therefore there is a problem that a measure is required, for example, to reduce the density of a current which flows in the coils as in the case of the insulation oil so that a heat loss which occurs in the coil groups may be small and the dimensions of the apparatus become larger.

SUMMARY OF THE INVENTION

Object

An object of the present invention made to solve the above described problems is to provide a compact and economical stationary induction apparatus in which the refrigerant to be passed through the cooler is effectively cooled without causing any abnormality such as static charge even though the refrigerant is circulated so that all the refrigerant contributes to cooling of the coil groups and the core and for which a measure is not required to reduce the density of the current which flows through the coil groups.

Means for Solving the Problems

A core type oil-supplied stationary induction apparatus in accordance with the present invention is constructed so that the coil groups which are stacked in multiple layers around the core are divided into a plurality of sub-groups each including several coils, these stacked coil sub-groups are arranged so as to be surrounded by donut-shaped refrigerant guides with a U-shaped cross section which are provided with an opening on the internal peripheral surface of every other coil sub-group and a plurality of refrigerant flow ports for admitting the flow of refrigerant on the external peripheral surface, and the flow ports provided on the external peripheries of the refrigerant guides are communicated with the refrigerant chamber into which the refrigerant from the cooler is discharged, by the internal piping.

A core type oil-supplied stationary induction apparatus in accordance with the present invention is constructed so that the stacked-up coils of the internal coil group and the external coil group which are concentrically arranged around the leg part of the core as the center are divided into a plurality of coil sub-groups which respectively include several coils, a plurality of these coil sub-groups are inserted so as to be surrounded by donut-shaped refrigerant guides with a U-shaped cross section which are provided with an opening at the internal peripheries of the refrigerant guides and a plurality of refrigerant flow ports for admitting the flow of refrigerant with a same specified interval on the external peripheries of the refrigerant guides for every other coil sub-group, an insulation tube is provided between the internal coil group and the external coil group, the refrigerant flow ports provided on the external peripheries of the refrigerant guides and the refrigerant chamber which is formed in the lower part of the tank and discharges the refrigerant cooled by the cooler are connected with internal pipes, and the internal coil group is cooled by introducing the cooled refrigerant from the refrigerant chamber formed below the tank and circulating the refrigerant up to the upper part along the side surfaces of the coil groups.

A core type oil-supplied stationary induction apparatus in accordance with the present invention is constructed so that the coil groups which are concentrically arranged around the leg part of the core are divided into a plurality of coil sub-groups, donut-shaped refrigerant guides with a U-shaped cross section which are provided with an opening at the internal peripheries of the refrigerant guides and a plurality of refrigerant flow ports for admitting the flow of refrigerant with a same specified interval on the external peripheries of the refrigerant guides are inserted between the divided coil sub-groups, and the refrigerant flow ports provided on the external peripheries of the refrigerant guides and the refrigerant chamber from which the refrigerant cooled by the cooler are communicated with internal pipes.

A shell type oil-supplied stationary induction apparatus in accordance with the present invention is constructed so that the coil groups which are formed by stacking up a plurality of plate type coils are horizontally arranged, a high voltage coil group is arranged at the center and a low voltage coil group is divided into two coil sub-groups, which are respectively arranged above and below the high voltage coil group, refrigerant guides with a U-shaped cross section which are provided with an opening on their internal peripheries and a refrigerant flow port which serves a passage for the refrigerant on both ends of the external peripheries are inserted between the coil groups, and the refrigerant flow ports provided on the external peripheries of the refrigerant guides and the inlet port of the cooler are communicated with internal pipes.

A shell type oil-supplied stationary induction apparatus in accordance with the present invention is constructed so that a clearance is provided as a refrigerant passage at a center of stacked-up cores, the coil groups formed by stacking up plate type coils in multiple layers to traverse through the core are horizontally arranged, a high voltage coil group is arranged at the center and a low voltage coil group is divided into two coil sub-groups, which are respectively arranged above and below the high voltage coil group, refrigerant guides with a U-shaped cross section which are provided with an opening on their internal peripheries and a refrigerant flow port which serves a passage for the refrigerant on both ends of the external peripheries are inserted between the coil groups, and the refrigerant flow ports provided on the external peripheries of the refrigerant guides and the inlet port of the cooler are communicated by the internal pipes.

Operation

In the present invention, a refrigerant cooled by a cooler 9 is pressurized by a pump 10, supplied from the internal pipes into the coil sub-groups surrounded by the refrigerant guide 16, and flows in parallel through the inter-layer clearances of the stacked coil groups (internal coil group 3 and external coil group 4) toward the leg part of the core 2 through the spacer. The refrigerant flow is separated into an upper flow and a lower flow and reversed at the external periphery of the leg part of core 2 and the refrigerant flows toward the external periphery through the inter-layer clearances of the coil sub-groups for which the refrigerant guides are provided. Therefore, the length of the flow passage can be short, the temperature of refrigerant passing through the inter-layer clearances of the coils will not be so high, the refrigerant can be satisfactorily cooled even though the flow speed is not increased, and a static charging phenomenon, which will occur when the flow speed is accelerated, can be avoided.

Also in the present invention, the refrigerant cooled by the cooler is pressurized by the pump and divided at the external periphery of the insulation tube into a flow of refrigerant which flows up from the refrigerant flow ports provided at the lower end part of the internal coil group along the surface of the internal coil group and another flow of refrigerant which flows from the internal pipes into the coil sub-groups of the external coil group, which are surrounded by the refrigerant guide, further flows in parallel through the inter-layer clearances of the disc type coils, which are stacked up with spacers therebetween, then is reversed at the external periphery of the insulation tube. In this case, the refrigerant flows toward the external periphery through a part where the refrigerant guides are not provided and therefore the length of the flow passage can be short, the temperature of refrigerant passing through the inter-layer clearances of the coils will not be so high, the refrigerant can be satisfactorily cooled even though the flow speed is not increased, and a static charging phenomenon, which will occur when the flow speed is accelerated, can be avoided.

Also in the present invention, the refrigerant cooled by the cooler is pressurized by the pump flows from the internal pipes into the refrigerant guide up to the leg part of the core and is divided into the upper and lower flows and reversed at the external periphery of the core, and flows toward the external periphery in parallel through the inter-layer clearances of the disc type coils which are stacked up with spacers provided therebetween. Therefore, the length of the flow passage can be short, the temperature of refrigerant passing through the inter-layer clearances of the coils will not be so high, the refrigerant can be satisfactorily cooled even though the flow speed is not increased, and a static charging phenomenon, which will occur when the flow speed is accelerated, can be avoided.

Also in the present invention, the refrigerant is circulated in the circulation channel where it is guided to traverse through the core, introduced into the inlet port of the cooler communicated with the ends of the refrigerant guides inserted between respective adjacent coil sub-groups of a plurality of divided coil groups by the internal pipes and cooled in the cooler, then flows into the tank and further flows toward the leg part of the core through the inter-layer clearances of plate type coils, which are stacked up with spacers, of respective coil groups and is reversed on the surfaces of the leg part of the core ,and sucked into the refrigerant guides. Therefore, the flow passage for the refrigerant through the inter-layer clearances of the coils can be short, the temperature of refrigerant passing through the inter-layer clearances of the coils will not be so high, the refrigerant can be satisfactorily cooled even though the flow speed is not increased, and a static charging phenomenon, which will occur when the flow speed is accelerated, can be avoided.

Further in the present invention, the refrigerant is circulated in the circulation channel where it is guided to traverse through the core, introduced into and cooled by the cooler which is communicated with both ends of refrigerant guides inserted between the coil groups which are divided into a plurality of coil sub-groups by the internal pipes, and flows into the tank, then the refrigerant introduced into the coil groups also flows through the clearance provided at the intermediate part of the core toward the leg part of respective inter-layer cores, which are formed by stacking up plate type coils with spacers inserted therebetween, of respective coil groups, and is reversed on the external peripheries of the leg part of the core and sucked into the refrigerant guides, thereby the core and the coil groups are cooled by the refrigerant thus circulated. Therefore, the flow passage for the refrigerant which flows through the inter-layer clearances of the coils can be short, the temperature of refrigerant passing through the inter-layer clearances of the coils will not be so high, the refrigerant can be satisfactorily cooled even though the flow speed is not increased, and a static charging phenomenon, which will occur when the flow speed is accelerated, can be avoided.

DESCRIPTION OF THE PREFERRED EMBODIMENT

Embodiment 1

Figure 1:
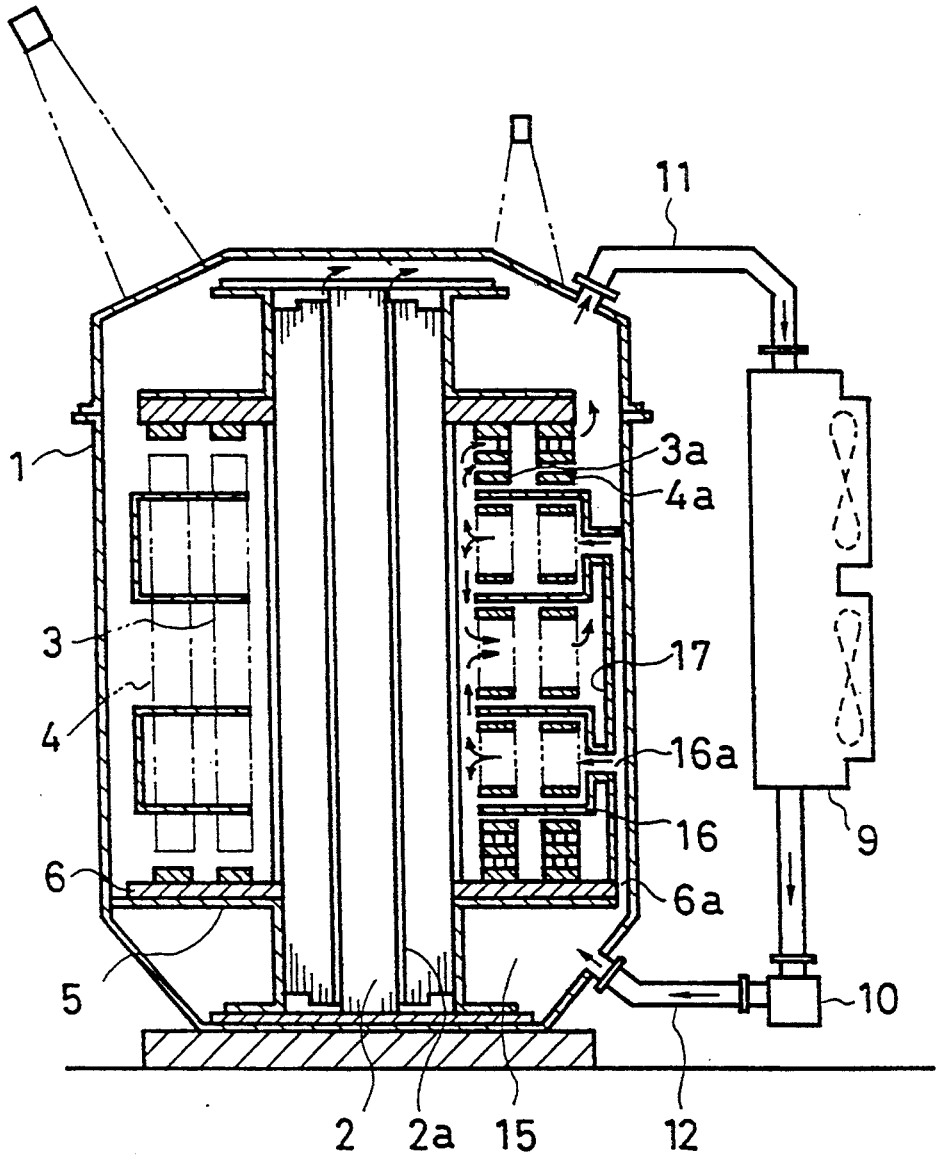
FIG. 1 is a vertical sectional view showing an internal construction of an oil-supplied type transformer in accordance with a first embodiment of the present invention.
Figure 2:
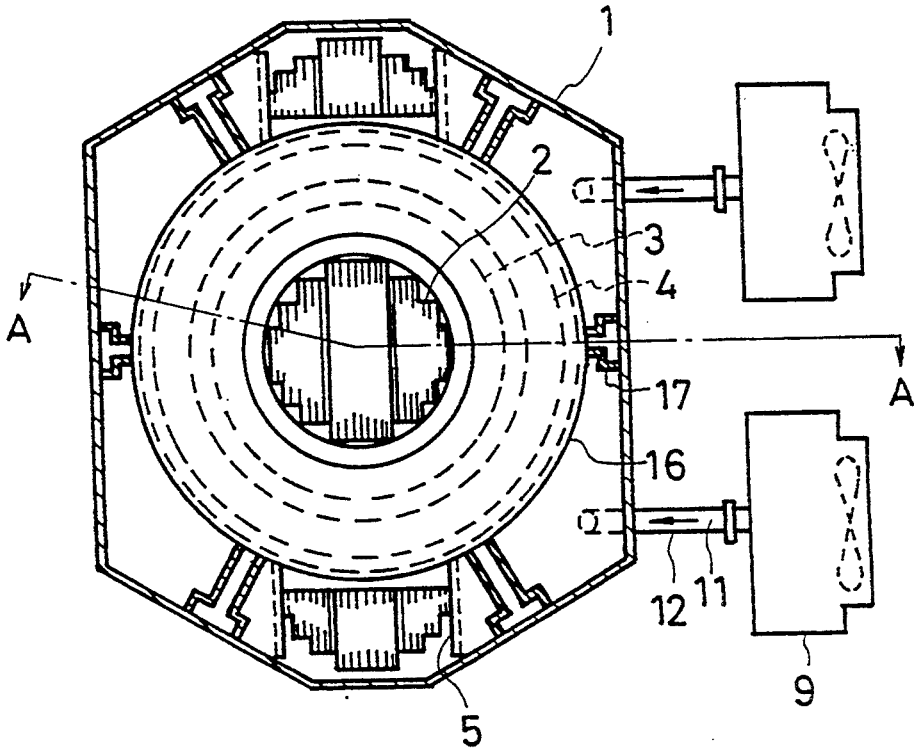
FIG. 2 is a cross sectional view of the oil-supplied type transformer in accordance with a first embodiment of the present invention.

FIGS. 1 and 2 are respectively a vertical sectional view and a cross sectional view showing an internal construction of a core type oil-supplied transformer as an embodiment of the present invention.

Figure 9:
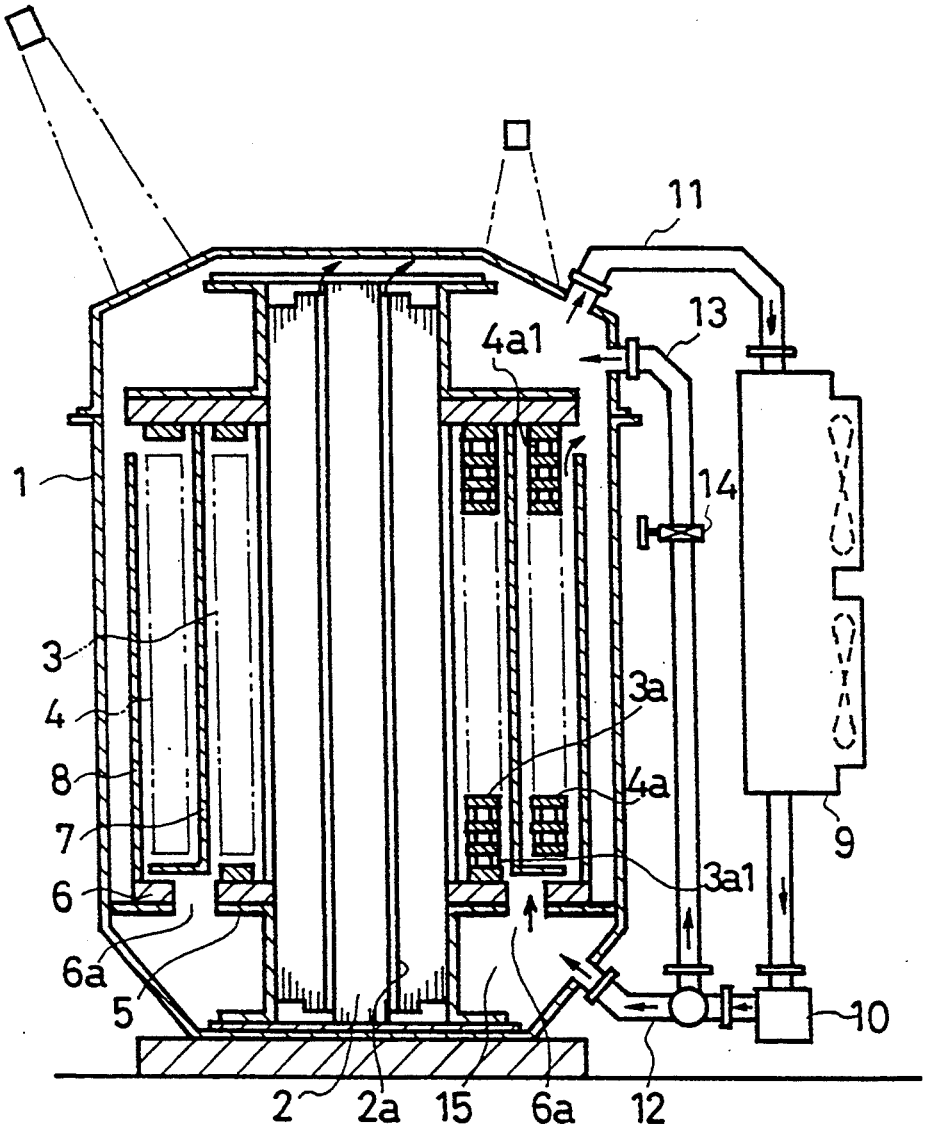
FIG.9 PRIOR ART
FIG. 9 is a vertical sectional view showing an example of a conventional core type oil-supplied transformer.
Figure 10:
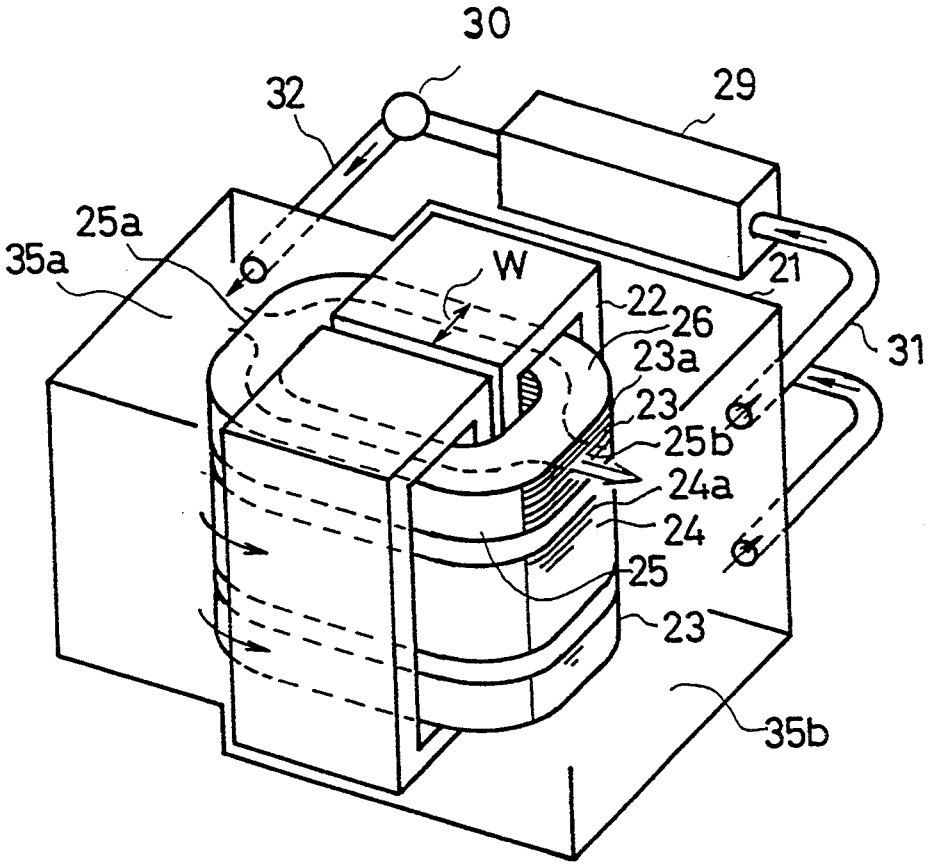
FIG.10 PRIOR ART
FIG. 10 is a perspective view showing an example of a conventional shell type oil-supplied transformer.

FIG. 2 shows a cross sectional view of the core type oil-supplied transformer shown in FIG. 1 and FIG. 1 shows a sectional view of he A—A part shown in FIG. 2. In the diagrams, 1~5, 9~12 and 15 denote the same components or functions shown in FIG. 9 and therefore the descriptions are omitted. 16 is a refrigerant guide with a U-shaped cross section which is inserted to surround every other coil sub-group of divided coil sub-groups and a plurality of refrigerant flow ports 6*a* are provided on the external periphery of the coil sub-group. 17 is an internal pipe which communicates the refrigerant chamber 15 at the lower part of the tank 1 of the main unit and the refrigerant guide 16. Arrows in the diagram show the direction of refrigerant flow.

The core 2 is formed by stacking up silicon copper sheets in multiple layers as the example of the prior art and is provided with a clearance 2*a* at the intermediate portion of the core so that the refrigerant can pass through it. The coil is doubly wound around the leg part of the core 2 as the center. In other words, the internal coil group 3 and the external coil group 4 are arranged and these internal coil group 3 and the external coil group 4 are formed by stacking up the disc type internal coils 3*a* and external coils 4*a* with spacers provided therebetween. As shown, the internal coil group 3 and the external coil group 4 are divided into a plurality of coil sub-groups each of which includes several coils and every other coil sub-group is inserted to be surrounded by the refrigerant guide 16 whereby several refrigerant flow ports 16*a* on the external periphery of the refrigerant guide 16 are communicated by the internal pipes with the refrigerant chamber 15 in the lower part of the tank at a plurality of positions as shown in FIG. 1. The core 2 is constructed so that the refrigerant from the refrigerant chamber 15 flows through the ambiance of the leg part of the core and the clearance 2*a* at the intermediate position of the stacked core sheets.

In the core type oil-supplied transformer with the arrangement as described above, the refrigerant is pressurized by the pump 10 and flows into the lower part of the tank, and a partial flow of the refrigerant flows up along the leg part of the core 2 to cool and a greater part of the refrigerant flows from the refrigerant chamber 15 into the refrigerant guide 16 through the internal pipes. The refrigerant flows toward the leg part of the core 2 through the inter-layer clearances of the disc type internal coils 3*a* and external coils 4*a* which are stacked up in multiple layers with spacers inserted therebetween. After this, the refrigerant is reversed at the surface of the leg part of the core 2 (see the arrows shown in FIG. 1) to the upper flow and the lower flow and flows towards the external periphery of the core through the inter-layer clearances of the coil sub-groups for which the refrigerant guide 16 is not inserted and flows up from the external periphery to the upper part of the tank 1. The refrigerant which has flown into the upper part of the tank 1 is let to flow into the cooler 9 from the piping 11 which communicates the upper part of the tank 1 and the upper part of the cooler 9 and circulated in the circulation channel which reaches the pump 10. When the refrigerant is circulated as described above, the refrigerant in the internal coil group 3 and the external coil group 4 flows in the horizontal direction through the inter-layer clearances formed by the disc type internal coils 3*a* and the external coils 4*a* which are stacked in multiple layers. Therefore the refrigerant flow passage can be short, the temperature of refrigerant which flows through the inter-layer clearances of the internal coil group 3 and the external coil group 4 will not be so high, the refrigerant can be satisfactorily cooled even though the flow speed is not accelerated, and the so-called fluidity static charging that static electricity is produced by friction of the insulation and the refrigerant and the insulation member is charged when the flow speed is accelerated can be avoided.

Embodiment 2

Figure 3:
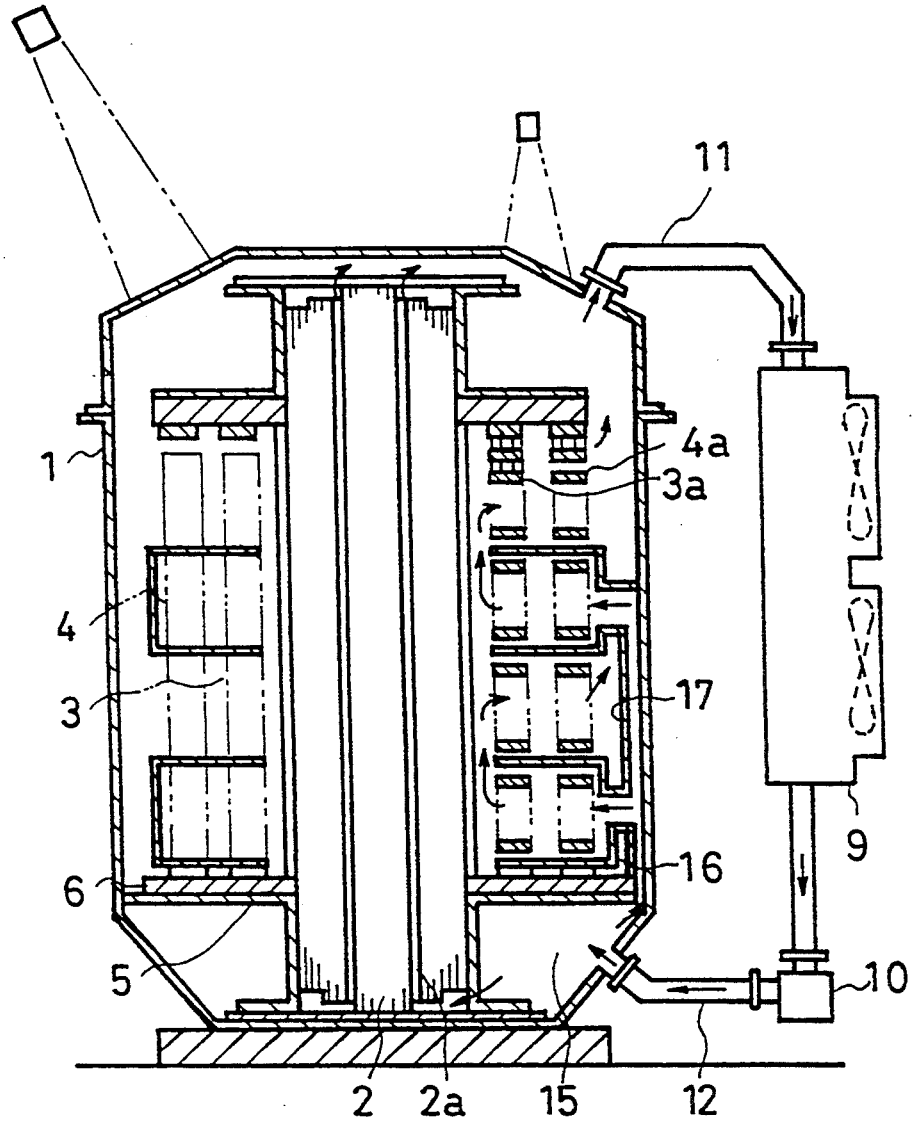
FIG. 3 is a vertical sectional view showing an internal construction of an oil-supplied type transformer in accordance with a second embodiment of the present invention.

FIG. 3 shows a core type oil-supplied transformer according to the second embodiment of the present invention. While in the first embodiment the coil sub-group to be surrounded by the refrigerant guide 16 is defined as the coil sub-group at the even number order from the lowest, in the second embodiment such coil sub-group is defined as the coil sub-group at the odd number order from the lowest. While in the first embodiment the coil sub-group at the even number order is surrounded by the refrigerant guide 16, the refrigerant flow which is reversed at the leg part of the core 2 is divided into the upper flow and the lower flow and flows toward the external periphery through the coil sub-group which is not surrounded by the refrigerant guide 16, in the second embodiment the refrigerant flow which has been reversed at the leg part of the core 2 is forced to flow in one direction, that is, toward the external periphery through the inter-layer clearances of the coil sub-groups which are not surrounded by the upper refrigerant guides 16. Such construction enables the refrigerant to flow through all coil sub-groups owing to natural convection even when the pump 10 fails for a certain reason and therefore the self-cooling capacity is larger than the first embodiment.

Embodiment 3

Figure 4:
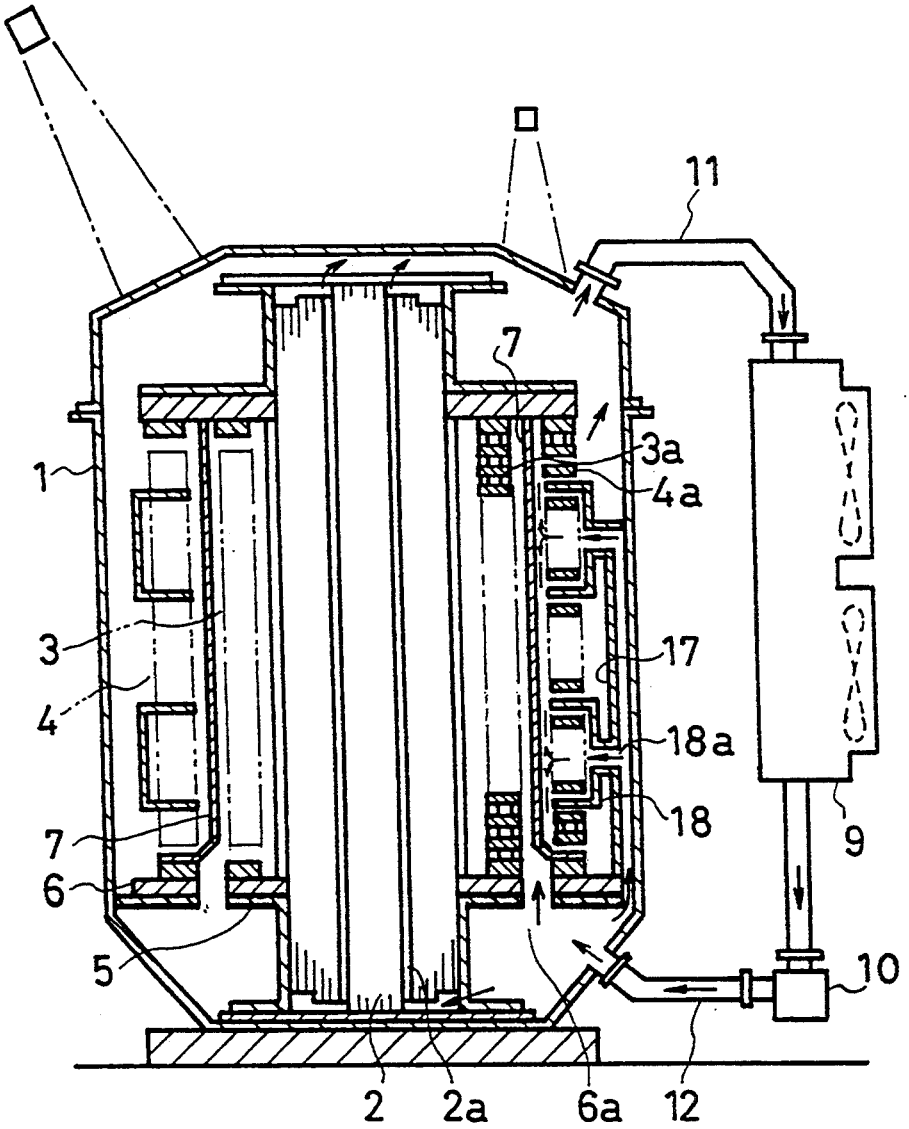
FIG. 4 is a vertical sectional view showing an internal construction of an oil-supplied type transformer in accordance with a third embodiment of the present invention.

FIG. 4 shows a core type oil-supplied transformer in accordance with a third embodiment of the present invention and the thickness of the insulation applied to the coil groups (internal coil group 3 and external coil group 4) is determined in relation to the voltage, and therefore it is more difficult to cool the high voltage coil group since the thickness of the insulation is increased as the voltage becomes larger. In this embodiment 3, the internal coil group 3 for which the insulation is thin and the voltage is low is not surrounded by the refrigerant guide 18 and is cooled only by the upward flow of refrigerant as in the example of the prior art. On the contrary, the external coil group 4 for which the insulation is thick so as to be difficult to cool and the voltage is large is divided into a plurality of sub-groups each of which includes several coils and the plurality of these coil sub-groups are inserted so that every other coil sub-group is surrounded by the refrigerant guide 18. The refrigerant flow ports 18*a* on the external periphery of the refrigerant guide 18 and the refrigerant chamber 15 in the lower part of the tank are communicated with internal pipes 17 at a plurality of positions as shown in FIG. 4. The refrigerant passage is separated by providing an insulation barrier between the internal coil group 3 and the external coil group 4. In the arrangement as described above, the refrigerant at the side including the leg part of the core 2 and the internal coil group 3 forms the upward refrigerant flow and the refrigerant in the external coil group 4 forms the horizontal refrigerant flow guided by the refrigerant guide 18 to flow through the inter-layer clearances of the disc coils 4*a* which are stacked up in multiple layers with spacers inserted therebetween. Therefore, the length of the refrigerant passage is short, the temperature of the refrigerant passing through the internal coil group 3 and the external coil group 4 will not be so high, the refrigerant can be cooled satisfactorily even though the flow speed is not accelerated and the static charge due to fluidity which occurs when the flow speed is accelerated can be avoided.

Embodiment 4

Figure 5:
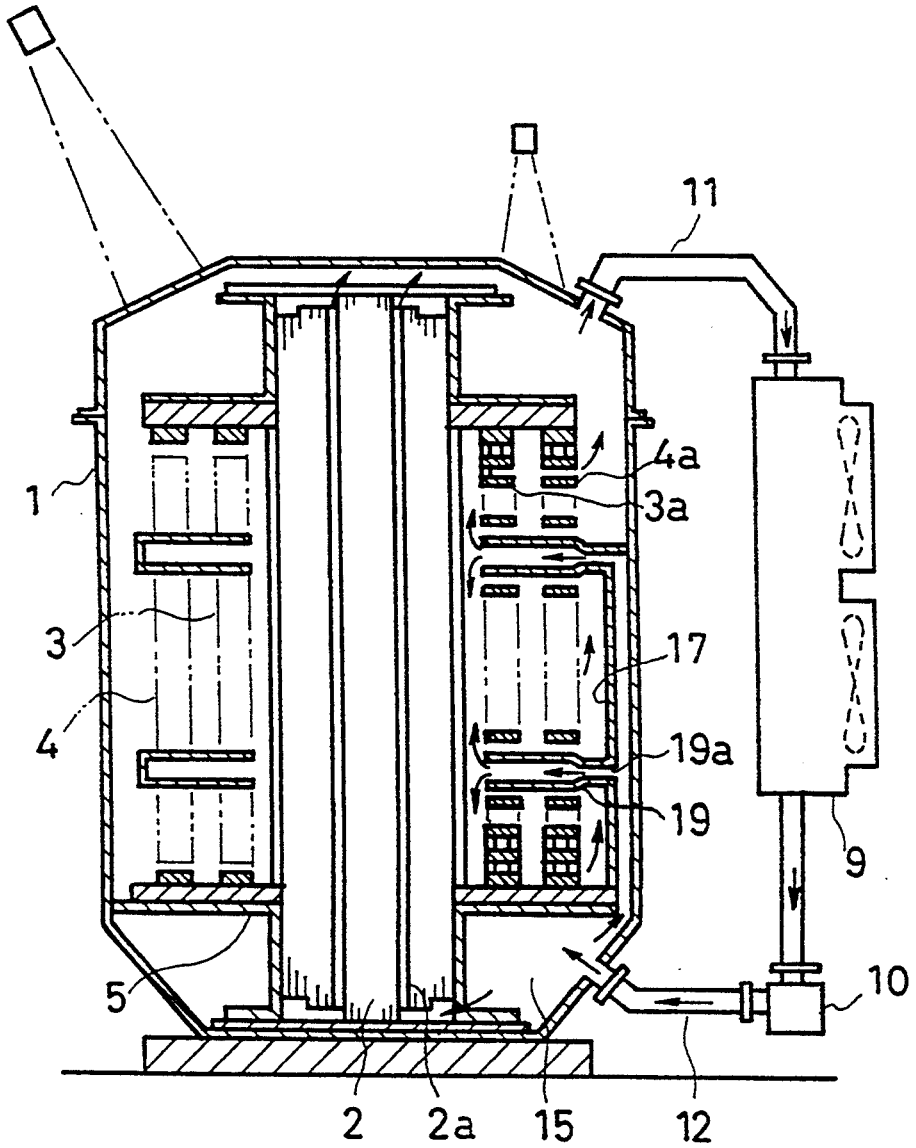
FIG. 5 is a vertical sectional view showing an internal construction of an oil-supplied type transformer in accordance with a fourth embodiment of the present invention.

FIG. 5 shows a core type oil-supplied transformer according to the present invention. A different point from the first embodiment is that the internal coil group 3 and the external coil group 4 which are concentrically arranged around the leg part of the core as the center are totally divided into a plurality of sub-groups, a refrigerant guide 19 with a U-shaped cross section is arranged between the divided coil sub-groups, refrigerant flow ports provided on the external periphery of the refrigerant guide 19 and a refrigerant chamber 15 are communicated with internal pipes, and the refrigerant from the refrigerant chamber 15 flows from the refrigerant guide 19 into the leg part of the core 2 through the internal pipes 17 and is separated into an upper flow and a lower flow and reversed (changes its flow direction) at the external periphery of the leg part of the core 2, further flows as a horizontal refrigerant flow from the internal peripheral parts to the external peripheral parts of the disc type internal coils 3*a* and external coils 4*a*, which are stacked with spacers inserted therebetween, of the internal coil group 3 and the external coil group 4 to directly cool the disc type internal coils 3*a* and external coils 4*a*. In the above arrangement, the refrigerant flows through the inter-layer clearances of the internal coil group 3 and the external coil group 4 from the internal peripheral part toward the external peripheral part. In this case, the refrigerant flow passage becomes shorter and therefore the temperature of the refrigerant which is passing through the coil groups will not be so high and the so-called fluidity static charging phenomenon which occurs when the velocity of the refrigerant flow is accelerated can be avoided.

Embodiment 5

Figure 6:
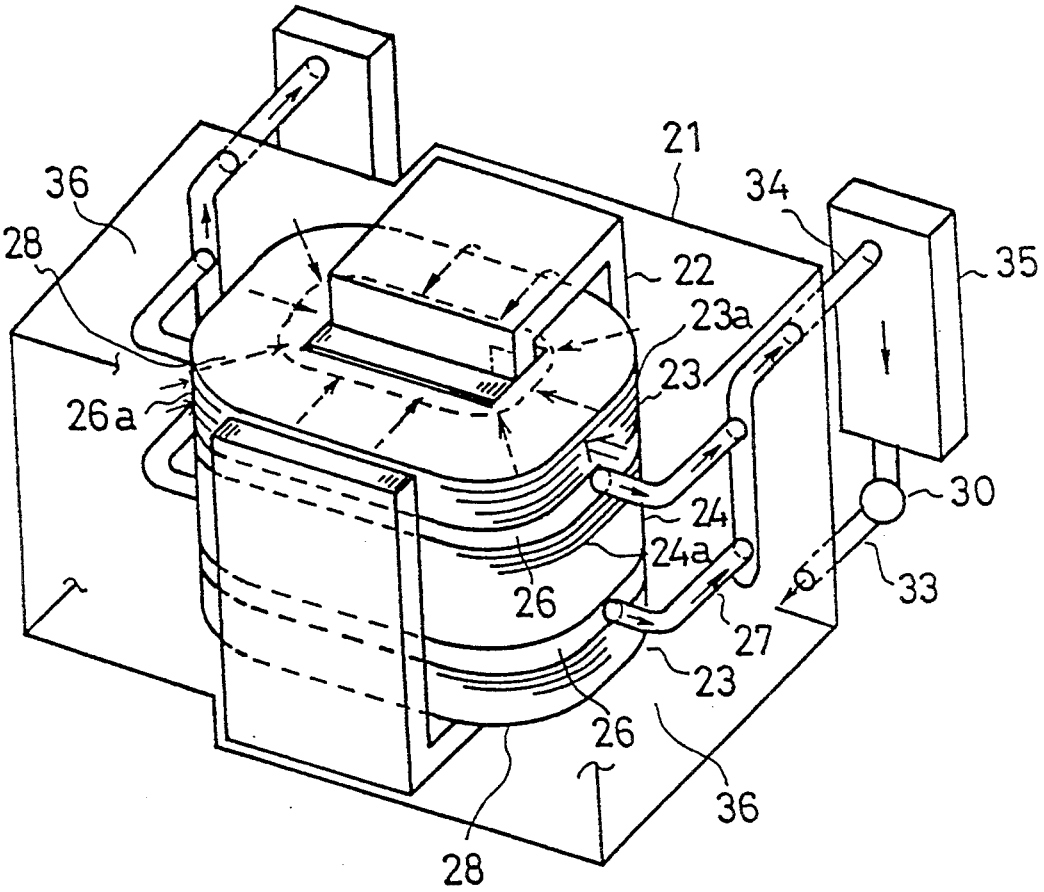
FIG. 6 is a perspective view showing an internal construction of an oil-supplied type transformer in accordance with a fifth embodiment of the present invention.

FIG. 6 is a perspective view showing a shell type oil-supplied transformer according to the fifth embodiment of the present invention. In FIG. 6, 21 is a tank which houses the main unit and is filled with the refrigerant, 22 is a core made up by stacking up silicon steel sheets in the shape of a frame, 23 is a low voltage coil group formed by stacking up flat plate type coils 23*a* with spacers, not shown, inserted therebetween, and 24 is a high voltage coil group formed by stacking up flat plate type coils 24*a* with spacers, not shown, inserted therebetween. The low voltage coil group 23 is divided into two sub-groups, which are arranged above and below the high voltage coil group as the center. 26 is a refrigerant guide which is inserted between the low voltage coil group 23 and the high voltage coil group 24, provided with an opening on its internal periphery and is formed to have a C-shaped cross section. 27 is an internal piping which extents from its piercing position of the external pheriphery of the refrigerant guide 26: namely, the internal piping 27 is provided on the external side of the refrigerant guide 26 and the refrigerant flows into the internal region surrounded by the coils from the external periphery of coils, takes a U-turn in that region, flows into the refrigerant guide 26 from the internal opening of the refrigerant guide 26, and flows out through the internal piping 26. 28 is partitions which are arranged on the upper end surface and the lower end surface of the low voltage coil group 23 and the high voltage coil group 24 which are stacked up and form the refrigerant passage so that the refrigerant flows only on the surfaces of plate type low voltage coils 23*a* and high voltage coils 24*a* of the low voltage coil group 23 and the high voltage coil group 24, and also the insulation plates serving as the insulation barriers for ensuring the dielectric strength between the low voltage coil group 23 and the core 22. 30 is a pump, 33 is a piping for connecting the outlet port of the cooler and the tank 21, 34 is a piping for connecting the internal piping 27 and the cooler, and 35 is a cooler. The pump 30, piping 33, piping 34 and the cooler 35 are provided at both sides of the core 22 so that the core 22 is sandwiched by these provisions. 36 is a refrigerant chamber formed at both ends of the tank 1.

Figure 7:
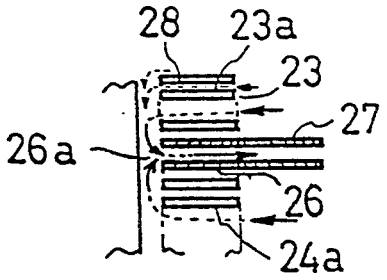
FIG. 7 is a partial sectional view of a coil of a part in which the refrigerant guide in accordance with the fifth embodiment of the present invention.

In a shell type oil-supplied transformer which is arranged as described above, the refrigerant flows from the refrigerant guide 26 inserted between the low voltage coil group 23 and the high voltage coil group 24 into the cooler 35 through the internal piping 27 and the piping 34 when the pump installed at the outlet port of the cooler 35 is operated, and further flows into the refrigerant chambers 36 at both sides of the core of the tank 21 after having cooled in the cooler 35. The refrigerant which has flown into the refrigerant chambers is circulated in the circulation channel throughout which the refrigerant flows from the overall periphery of the clearances of plate type coils 23*a* and 24*a* which are stacked up with spacers inserted therebetween from the external periphery of the low voltage coil group 23 and the high voltage coil group 24 toward the leg part of core 22 and is reversed at the leg part of core 22, then flows from the refrigerant guide 26 into the cooler 35 through the internal piping 27 and the piping 34. FIG. 7 shows a partial sectional view of part of the refrigerant guide 26. In the embodiment shown in FIG. 6, the cooler 35 is provided in the refrigerant chamber 36 respectively at both ends of the tank 1 and adapted to suck the refrigerant by the refrigerant guide 26 and, as the refrigerant is sucked from both ends of the refrigerant guide 26, the refrigerant flow passage is formed where the refrigerant flows in a horizontal direction from the external periphery of the coils to the leg part of core 22 along the overall periphery of the inter-layer clearances of the low voltage coil group 23 and the high voltage coil group 24 which are stacked in multiple layers. By forming such a refrigerant flow passage, the length of the refrigerant flow passage becomes shorter and the temperature of the refrigerant passing through the inter-layer clearances of the low voltage coil group 23 and the high voltage coil group 24 will not be so high and therefore the refrigerant can be satisfactorily cooled even though the velocity of the refrigerant flow is not accelerated, and the so-called fluidity static charging phenomenon which occurs when the velocity of the refrigerant flow is accelerated can be avoided.

Embodiment 6

Figure 8:
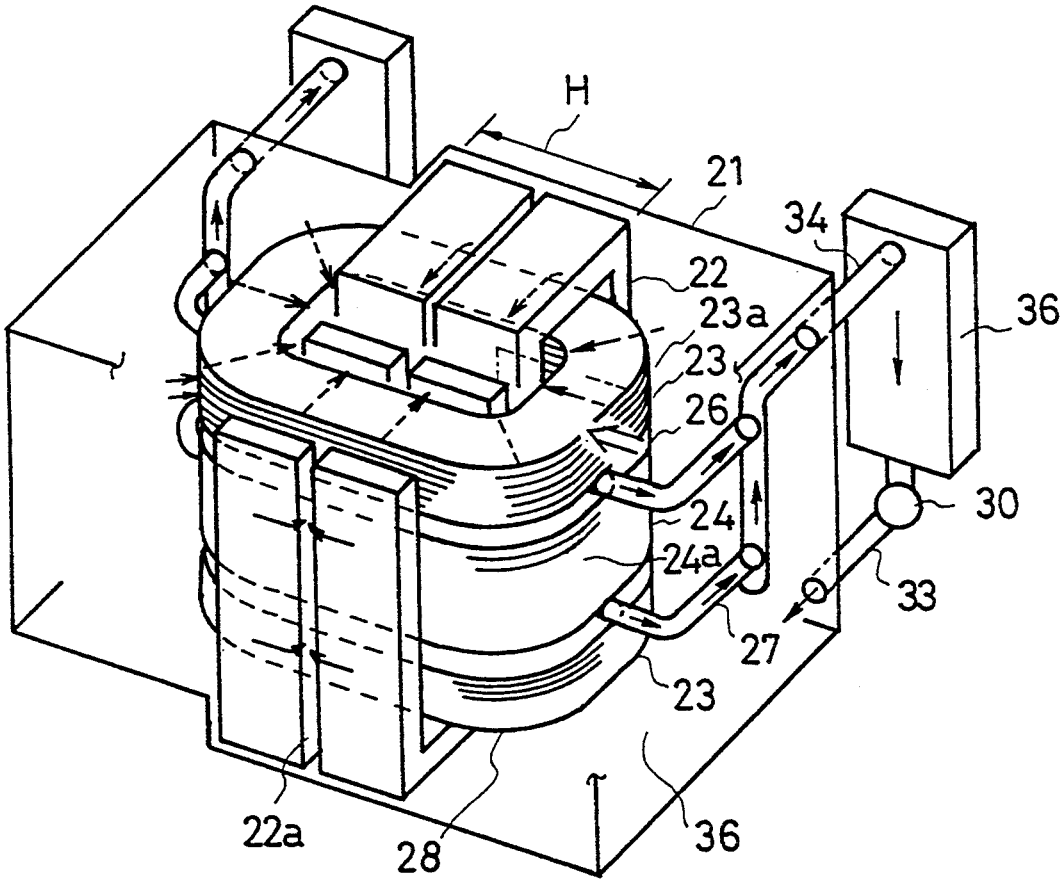
FIG. 8 is a vertical sectional view showing an internal construction of an oil-supplied type transformer in accordance with a sixth embodiment of the present invention.

FIG. 8 is a perspective view showing a shell type oil-supplied transformer in accordance with the sixth embodiment of the present invention. The difference of the sixth embodiment from the fifth embodiment is that the clearance 22*a* provided at the intermediate part of the stacked silicon steel sheets is added to the construction of the core 22 so that the refrigerant to be sucked by the low voltage coil group 23 and the high voltage coil group 24 may flow from the clearance 22*a* at the intermediate part of core 22. The provision of this clearance not only enables to make the refrigerant flowing into the low voltage coil group 23 and the high voltage coil group 24 uniform along the overall periphery of the coil groups but also facilitates cooling of the core 22.

Effect of the Invention

The present invention provides the following effects with the above described arrangement.

A core type oil-supplied stationary induction apparatus in accordance with the present invention is arranged so that the coil groups, which are concentrically arranged around the leg of the core, are divided into a plurality of sub-groups, every other coil sub-group is surrounded by the refrigerant guide, and the refrigerant flows in the horizontal direction in the clearance of the disc type coils which are stacked with spacers inserted therebetween. Therefore, the refrigerant flow passage becomes shorter, the refrigerant is satisfactorily cooled even though the velocity of refrigerant flow is not accelerated since the refrigerant is cooled by the upper and lower surfaces of the disc coils and the so-called fluidity static charging phenomenon which occurs when the velocity of the refrigerant flow is accelerated can be avoided. Thus, such stationary induction apparatus can be obtained.

A core type oil-supplied stationary induction apparatus in accordance with the present invention is adapted so that a coil group, of the coil groups concentrically arranged around the leg part of the core, which is given a thick insulation cover and externally arranged is surrounded by a refrigerant guide and the refrigerant flows in a horizontal direction through the inter-layer clearances formed with spacers inserted and therefore the refrigerant flow passage of this part becomes shorter and the refrigerant is cooled by the upper and lower surfaces of the disc-shaped coils. Generally, the coil group to be arranged at the internal side is a low voltage coil group, its insulation cover is thin and the refrigerant is satisfactorily cooled only in the upward flow along the side surfaces of the stacked-up coils. Therefore, a stationary induction apparatus is obtained in which the cooling effect is properly balanced between the internal coil group and the external coil group, the velocity of the refrigerant flow need not be accelerated as a whole and the so-called fluidity static charging phenomenon which occurs when the velocity of refrigerant flow is accelerated is prevented.

A core type oil-supplied stationary induction apparatus in accordance with the present invention is adapted so that the internal coil group and the external coil group which are concentrically arranged around the leg part of the core as the center are totally divided into a plurality of coil sub-groups, a refrigerant guide is inserted into the divided coil sub-groups, and the refrigerant is introduced from the internal piping and the refrigerant guide into the internal periphery of the coil groups to flow in a horizontal direction from the internal periphery toward the external periphery. Therefore, such a stationary induction apparatus is obtained that the fluidity resistance of the refrigerant passage is small, the refrigerant is satisfactorily cooled, the velocity of the refrigerant flow need not be accelerated and the so-called fluidity static charging phenomenon which occurs when the velocity of refrigerant flow is accelerated is prevented.

A shell type oil-supplied stationary induction apparatus in accordance with the present invention is adapted so that the coil groups which are arranged to traverse through the core are divided into a plurality of coil sub-groups, a refrigerant guide is inserted between the divided coil sub-groups, both ends of the refrigerant guide are communicated with the cooler by an internal piping and the refrigerant is directly sucked from the coil sub-groups into the cooler. Therefore, such a stationary induction apparatus is obtained that the refrigerant in the coil sub-groups flows in a horizontal direction from the external periphery of the coils toward the leg part of the core through the inter-layer clearances of the stacked-up plate coils and is reversed at the leg part of the core to flow into a passage where the refrigerant is sucked from the refrigerant guide into the cooler whereby the refrigerant passage becomes shorter to ensure a uniform flow rate along the overall periphery of the coil groups, the refrigerant is satisfactorily cooled even though the velocity of refrigerant flow is not accelerated and the so-called fluidity static charging phenomenon which occurs when the velocity of refrigerant flow is accelerated is prevented.

A shell type stationary induction apparatus is adapted so that a clearance is provided at the intermediate part of the core made up by stacking silicon steel sheets; a shell type stationary induction apparatus is obtained that the coil groups are cooled by a uniform refrigerant flow and the core can also be satisfactorily cooled.

What is claimed is:

1. A stationary induction apparatus in which coil groups formed by stacking up in multiple layers a plurality of plate coils arranged around a leg part of a core with inter-layer clearances formed therebetween which a refrigerant can pass through are stored in a tank having a refrigerant chamber filled with said refrigerant, a cooler for cooling said refrigerant is provided outside said tank, and said cooler is connected to said refrigerant chamber by an ejection pipe and a suction pipe so that said refrigerant is circulated in said tank through the ejection and suction pipes by the operation of said cooler to cool said coil groups, core and tank, wherein each of said coil groups is divided into a plurality of coil sub-groups each of which includes a certain number of plate coils in a stacking-up direction and refrigerant guides are provided in said tank to generate refrigerant flows for each of said coil sub-groups in inter-layer clearances between plate coils of each coil sub-group;

wherein each of said refrigerant guides is ring-shaped and surrounds one of said plurality of coil sub-groups;

wherein some, but not all, of said plurality of coil sub-groups are surrounded by said refrigerant guides;

wherein said refrigerant guides are respectively provided with an opening on their internal periphery and a plurality of refrigerant flow ports on their periphery; and wherein said refrigerant flow ports are connected to internal pipes which extend to a refrigerant ejection region of said refrigerant chamber.

2. A stationary induction apparatus according to claim 1, wherein said plurality of coil sub-groups surrounded by said refrigerant guides are defined as coil sub-groups at even number positions from one of the uppermost coil sub-group and the lowermost coil sub-group of stacked-up coil sub-groups, and said refrigerant is ejected from said cooler into the refrigerant ejection region of said refrigerant chamber through the ejection pipe so that it reaches said refrigerant guides through the internal pipes, flows toward the leg part of said core through the inter-layer clearances between plate coils of coil sub-groups surrounded by said refrigerant guides, changes its direction at the leg part of said core to both axial directions of said coil groups after it flows out of said refrigerant guides, and flows toward the external periphery of coil sub-groups through inter-layer clearances between plate coils of the coil sub-groups not surrounded by said refrigerant guides.

3. A stationary induction apparatus according to claim 1, wherein said plurality of coil sub-groups surrounded by said refrigerant guides are defined as coil sub-groups at odd number positions from an endmost coil sub-group of stacked-up coil sub-groups, and said refrigerant is ejected from said cooler into the refrigerant ejection region of said refrigerant chamber through the ejection pipe so that it reaches said refrigerant guides through the internal pipes, flows toward the leg part of said core through inter-layer clearances between plate coils of coil sub-groups surrounded by said refrigerant guides, changes its direction at the leg part of said core to one axial direction of said coil groups after it flows out of said refrigerant guides, and flows towards the external periphery of coil sub-groups through inter-layer clearances between plate coils of the coil sub-groups not surrounded by said refrigerant guides.

* * * * *